United States Patent [19]

Ketterer

[11] 4,374,503

[45] Feb. 22, 1983

[54] CHAIN STITCH DEVICE FOR LOCK STITCH SEWING MACHINES

[75] Inventor: Stanley J. Ketterer, Jamesburg, N.J.

[73] Assignee: The Singer Company, Stamford, Conn.

[21] Appl. No.: 248,086

[22] Filed: Mar. 27, 1981

[51] Int. Cl.[3] ..... D05B 1/14; D05B 57/04

[52] U.S. Cl. ..... 112/163; 112/201

[58] Field of Search ..... 112/168, 184, 197, 201, 112/202

[56] References Cited

U.S. PATENT DOCUMENTS

| | | | |
|---|---|---|---|
| 743,876 | 11/1903 | Huffman | 112/201 |
| 1,014,033 | 1/1912 | Baker et al. | 112/197 |
| 3,173,390 | 3/1965 | Bartosz | 112/184 |
| 3,253,560 | 5/1966 | Ketter et al. | 112/168 |
| 3,602,168 | 8/1971 | Yamashita | 112/168 |

*Primary Examiner*—Wm. Carter Reynolds

*Attorney, Agent, or Firm*—Robert E. Smith; Edward L. Bell

[57] ABSTRACT

A novel chain stitch sewing mechanism is disclosed in which thread loops which are retained for enchainment with thread loops introduced by subsequent needle penetration are released only in response to the action of the thread seized and manipulated during said subsequent needle penetration. A chain stitch conversion device for a conventional lock stitch sewing machine operating on this principle is disclosed. Also disclosed is a novel combination of a chain stitch forming mechanism with a sewing machine skip stitch mechanism.

7 Claims, 10 Drawing Figures

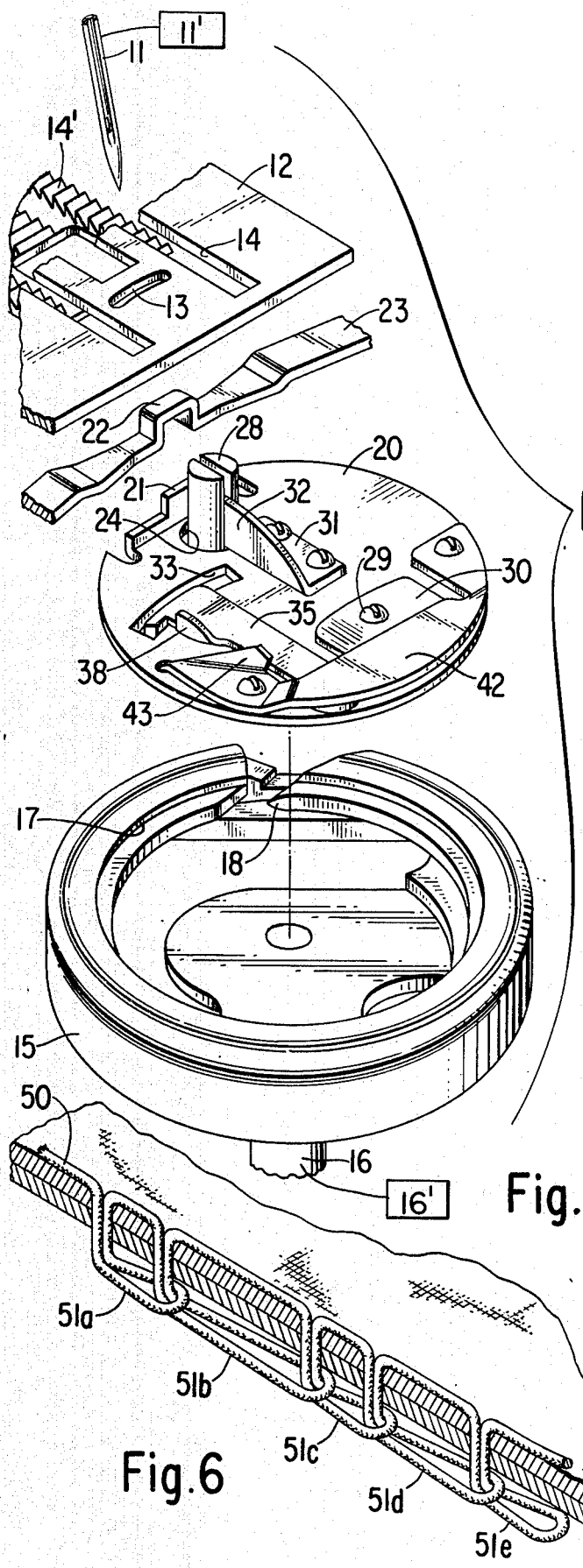
Fig.1
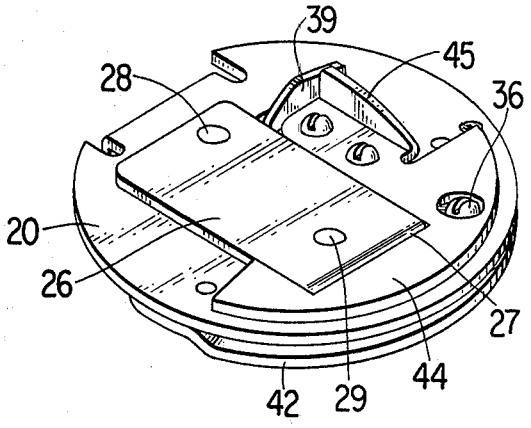
Fig.2
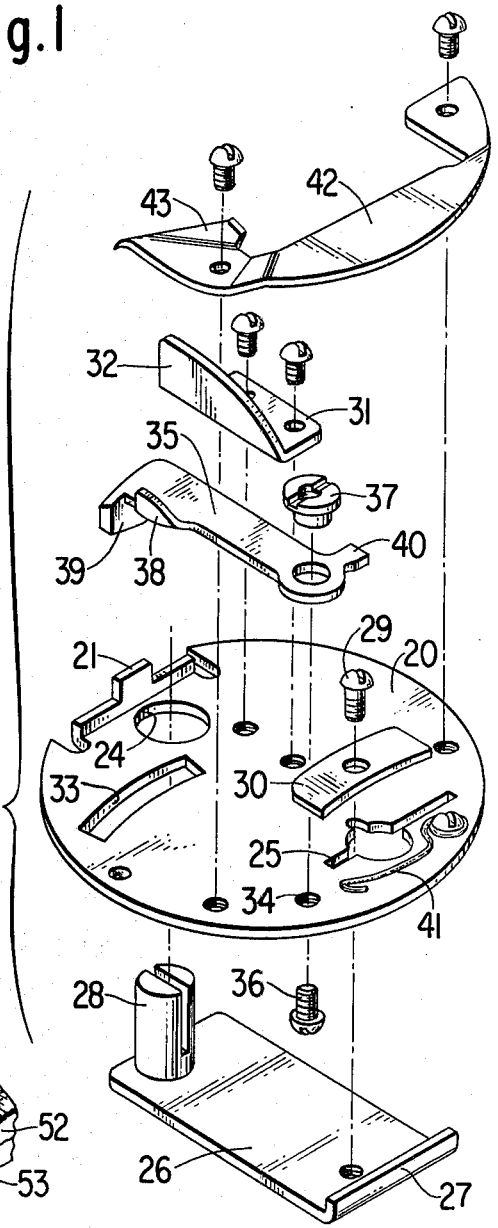
Fig.3
Fig.6

CHAIN STITCH DEVICE FOR LOCK STITCH SEWING MACHINES

DESCRIPTION

BACKGROUND OF THE INVENTION

This invention is in the art of sewing machines, relates to devices for forming chain stitches in a novel and advantageous manner, involves combinations with chain stitch mechanism heretofore unattainable, and more particularly, provides for a novel arrangement which may be used in a lock stitch machine for converting the mechanism to the production of chain stitches.

Many chain stitch mechanisms and chain stitch conversion devices are known in the prior art that operate by retaining a thread loop until it has been entered by the needle on the succeeding needle penetration. All of the prior art devices further share in common the attribute that shedding of the retained thread loop is effected as the result of a movement of a part of the sewing machine mechanism which is not necessarily related to the actual seizure and manipulation of the succeeding loop of thread. As a result, if for any reason loop seizure should fail to occur, the previously formed thread loop will be released without being enchained and the resulting interruption of the chain of loops can permit the seam to be raveled.

The U.S. Pat. of Bartosz No. 3,173,390, Mar. 6, 1965, is representative of the prior art and discloses a chain stitch forming conversion device for a lock stitch sewing machine in which a web on the sewing machine feed dog, during the recurring motion of the feed dog, engages and strips the retained thread loop from a thread loop retaining finger. In the mechanism of U.S. Pat. No. 3,173,390, the thread loop will be shed from the thread retainer whether or not the loop taker beak is successful in seizing the succeeding thread loop from the needle.

SUMMARY OF THE INVENTION

It is an object of this invention to provide a device for forming chain stitches which is designed to operate on a novel principle; namely, that shedding of each retained thread loop will be effected solely as result of the action of a subsequently seized needle thread limb. Preferably, the force on the needle thread limb which has been seized and is being manipulated by the loop seizing beak of the sewing machine loop taker is harnessed to effect shedding of the previously retained thread loop. The advantage of this novel arrangement is that a skipped stitch will not result in an interruption of the chain and the possibility of seam raveling from such interruption is obviated.

If in utilizing a mechanism in accordance with this invention, a stitch is skipped without interruption of a recurring work feed mechanism, the chain will not be interrupted but a long stitch will be formed. It therefore becomes possible purposely to skip stitches and by this means to provide long chain stitches for basting or for decorative purposes.

Another object of this invention is to provide a particularly effective mechanism for producing chain stitches in accordance with the novel principle of this invention.

A further object of this invention is to provide a chain stitch conversion device for a conventional lock stitch sewing machine embodying the novel principle of this invention.

DESCRIPTION OF THE DRAWINGS

The accompanying drawings illustrate a preferred embodiment of this invention in which:

FIG. 1 represents an exploded top perspective view of stitch forming instrumentalities or fragments thereof which are essential to the formation of chain stitches in accordance with this invention;

FIG. 2 is a bottom perspective view of the loop taker insert assembly of which the top perspective view is included in FIG. 1;

FIG. 3 is an exploded top perspective view of the essential elements of the loop taker insert assembly;

FIG. 5*c* is a cross-sectional view through the loop taker insert assembly taken substantially along line 5C—5C of FIG. 5*a;* and FIG. 6 is a perspective view of a single thread chain stitch produced by the mechanism of this invention.

DETAILED DESCRIPTION OF THE DRAWINGS

Figure 4A:
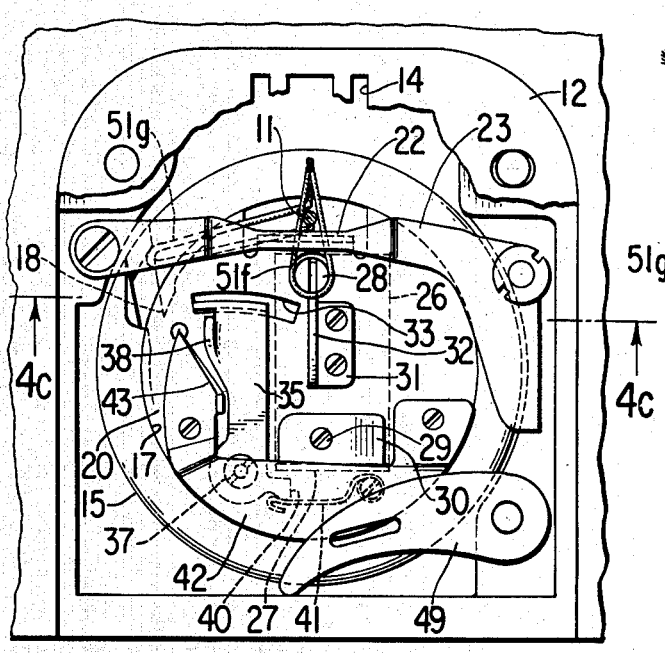
FIG. 4*a* is a top plan view of the assembled stitch forming instrumentalities illustrated in FIG. 1 showing the parts and the sewing threads as they are positioned immediately after loop seizure.
Figure 4B:
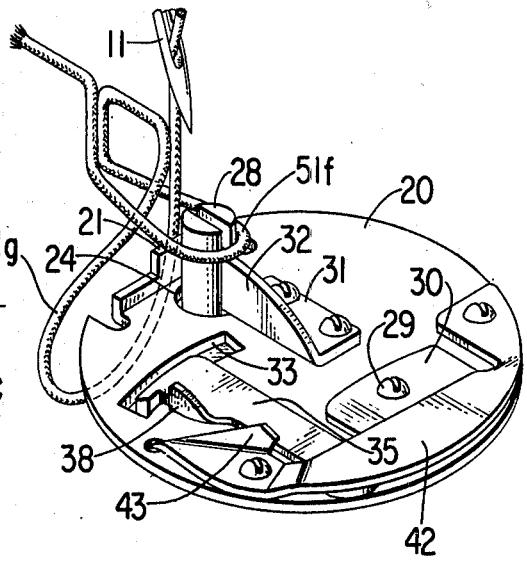
FIG. 4*b* is a top perspective view of the loop taker insert assembly showing the sewing threads in the same position as in FIG. 4*a;*
Figure 4C:
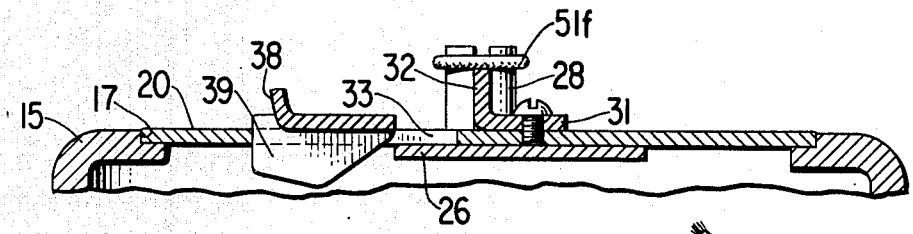
FIG. 4*c* is a cross-sectional view through the loop taker insert assembly taken substantially along line 4C—4C of FIG. 4*a;*

The chain stitch forming mechanism of this invention is compatable and adapted for use with any conventionally organized sewing machine. The U.S. Pat. No. 2,862,468, Dec. 2, 1958, is incorporated by reference herein and will serve to disclose a conventional sewing machine organization with which the present invention may be used. The term "conventional sewing machine organization" as used herein refers to the machine frame and work support, the thread carrying needle, loop taker, work feed mechanism arrangement, the actuation of these instrumentalities, as well as to the general thread handling arrangement, that is, the thread tension take-up etc. although it is well known that these thread controlling elements are preferably tailored to the specific requirements of each individual stitch forming mechanism.

Referring to FIG. 1 of the drawings, 11 indicates a thread carrying needle, 12 indicates a work supporting throat plate formed with a needle aperture 13 and slots 14 through which work feeding instrumentalities 14' are adapted to operate, and 15 indicates a loop taker formed integrally with a shaft 16 by which the loop taker is supported and driven in circular movement cooperatively with the needle 11 and work feeding instrumentality 14' by an actuating mechanism indicated by the graphical drawing symbol 16'. The loop taker is also formed with a circular bearing rib 17 and a loop seizing beak 18. The parts thus far described may be related and actuated in accordance with the U.S. Pat. No. 2,862,468 incorporated herein by reference. In that patent, the stitch forming mechanism includes other elements such as a bobbin and bobbin case which adapt the machine for the formation of lock stitches. In the present invention, preferably the bobbin and bobbin case are replaced by a support plate 20 which carries elements to be described below which cooperate in the formation of chain stitches. As shown in FIGS. 1 and 3, the support plate is formed with an upturned finger 21 which is straddled by an offset portion 22 formed on a bracket 23 carried by the sewing machine frame for restraining the support plate 20 from rotation with the loop taker when the support plate is positioned in the loop taker bearing rib 17. The support plate adjacent to the upturned finger 21 is formed with a circular aperture 24 and spaced therefrom the support plate is formed with an elongate aperture 25. Beneath the support plate, a flat plate 26 is arranged. The flat plate 26 is formed with an upturned rib 27 which enters the elongate aperture 25 to form a hinge and has an upstanding bifurcated pin 28 extending through the circular aperture 24. A screw 29 which also passes freely through the elongate aperture 25 and is threaded into the flat plate 26 secures an arched leaf spring 30 thereto above the support plate 20. The spring 30 biases the bifurcated pin 28 upwardly through the aperture 24. Secured on the upper surface of the support plate is a bracket 31 formed with a tapered upstanding fin 32 which projects between the bifurcations of the pin 28.

Alongside the flat plate 26, the support plate 20 is formed with an elongate clearance slot 33 which is preferably arcuate about a center coincident with a clearance hole 34 formed in the support plate. Above the support plate 20 is arranged a lever 35 pivotally supported on a screw 36 which passes through the clearance hole 34 and has a shouldered nut 37 threaded thereon. The lever 35 is formed with an upturned probe 38 and with a downturned cam blade 39 which projects through the clearance slot 33 in the support plate. A tab 40 formed on the lever 35 is engaged by a spring wire 41 secured on the support plate to bias the cam blade 39 in a direction radially outwardly away from the flat plate 26. A cover plate 42 which is secured on the support plate over the spring wire 41 and shouldered nut 37 is also formed adjacent to the probe 38 with an upturned thread deflecting fin 43.

Referring to FIG. 2, which illustrates the underside of the support plate 20, a cover plate 44 is secured beneath the support plate and is formed with a downturned thread deflecting fin 45 which terminates closely adjacent to the cam blade 39 of the lever 35.

The operation of the mechanism of this invention will now be described with particular reference to FIG. 6 illustrating the chain stitch concatenations and FIGS. 4*a, b, c* and 5*a, b* and *c* which illustrate the manner in which the mechanism of this invention operates to form chain stitches.

Figure 5A:
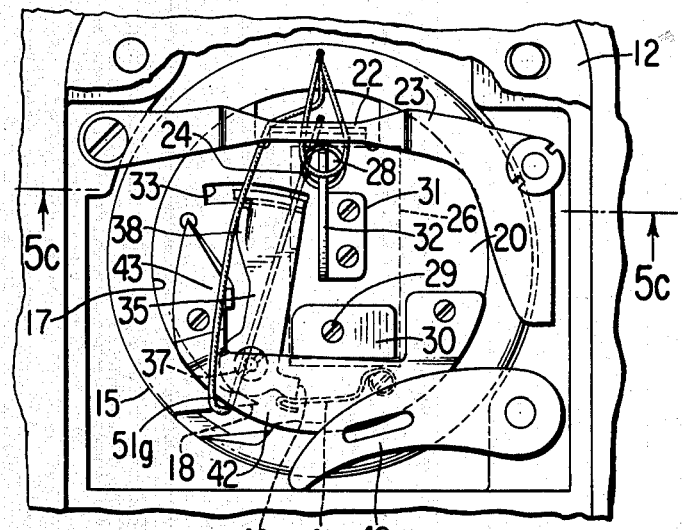
FIG. 5*a* is a top plan view of the assembled stitch forming instrumentalities similar to FIG. 4*a* but showing the parts and the sewing threads as they are positioned when the previously held thread loop is shed from the thread loop retainer.
Figure 5B:
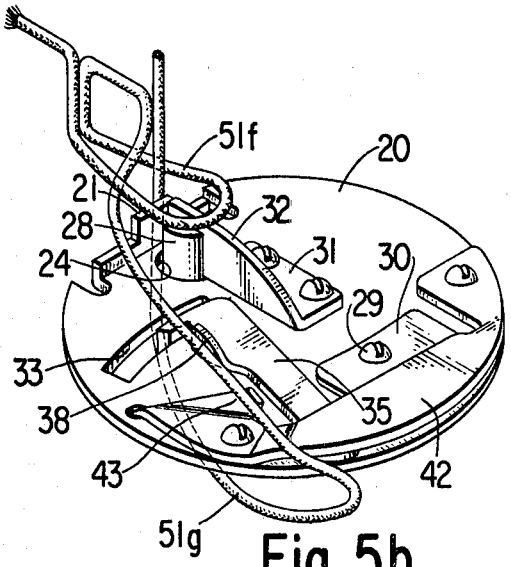
FIG. 5*b* is a top perspective view of the loop taker insert assembly similar to FIG. 4*b* but showing the sewing threads in the same position as in FIG. 5*a;*
Figure 5C:
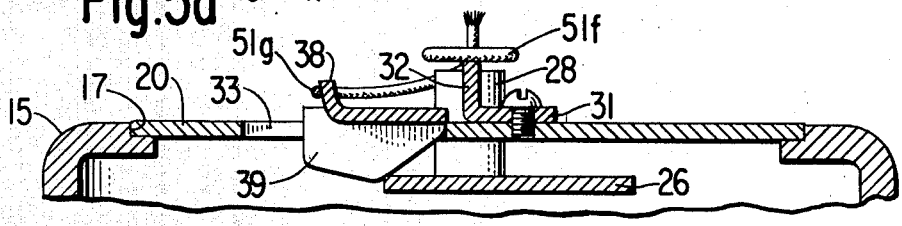

FIGS. 4*a* and 5*a* illustrate substantially all of the parts shown in FIG. 1 but in assembled relation FIGS. 4*a* and 5*a* further include a retractable bobbin case keeper lever 49 which, as shown, may be positioned so as to overhang and maintain the support plate 20 in place in the loop taker bearing rib 17.

As shown in FIG. 6, a single thread chain stitch involves a single thread 50 which is formed with a succession of loops 51*a, b, c, d, e*, each loop projected through one or more plies of work fabric 52, 53 as by needle penetration and each loop being projected through or enchained with the succeeding thread loop. In FIG. 6, the spacing between the needle penetrations for the loops 51*a* and 51*b* and between those for the loops 51*b* and 51*c* represent the maximum possible work advance during one cycle of operation of a sewing machine work feeding mechanism. It will be noted that three times the maximum possible work advance exists between the needle penetrations for the loops 51*b* and 51*c* and two times the maximum possible work advance exists between the needle penetrations for the loops 51*d* and 51*e*. Such abnormally long stitches are possible with this invention as a result of either intermediate needle penetrations during which loop seizure is purposely or inadvertently aborted, as a result of or suspension of needle reciprocation during repeated cycles of work advance mechanism operation. Such suspension of needle reciprocation may be effected by use of a skip stitch arrangement as disclosed in U.S. Pat. No. 3,872,809, Mar. 25, 1975 to Adams et al, which is incorporated herein by reference. In FIG. 1 such a skip stitch mechanism is indicated by the graphical drawing symbol 11'.

Referring to FIGS. 4*a, b,* and *c,* it will be appreciated that when the beak 18 of the loop taker seizes and manipulates a loop of thread from the needle 11, the thread loop will be distended and carried about the support plate 20 and as the thread loop is drawn up as by the thread control instrumentalities of the sewing machine it will be caught by and retained on the bifurcated pin 28. The retained thread loop will rest upon the fin 32 and will be spread and positioned by the pin 28 into a loop sufficiently wide as to accommodate ready entry by the needle 11 on the next succeeding needle penetration. FIGS. 4*a, b* and *c,* illustrates the position of sewing instrumentality parts with a thread loop 51*f* retained on the pin 28 and the succeeding thread loop 51*g* seized by the loop taker beak at the outset of manipulation of the succeeding thread loop by the loop taker.

Referring to FIGS. 5*a, b* and *c,* a position of parts is illustrated in which continued circular movement of the loop taker results in the beak 18 distending the succeeding thread loop 51*g* bringing one limb thereof into engagement with the probe 38 of the lever 35. Since the loop taker beak 18 is actively distending the thread loop 51*g* at this juncture, a tensile force exists in the thread of the loop 51*g* which urges the lever 35 in a clockwise direction as viewed in FIGS. 5*a* and *b* overcoming the force of the spring 41 and shifting the cam blade 39 against the plate 26 to depress the plate 26 against the action of the spring 30 and retract the pin 28 to a position at or below the level of the fin 32.

The preceding thread loop 51*f* which has been retained on the pin 28 will thus be shed therefrom and freed so that it may be set against the work being sewn either by the action of the sewing machine thread controlling devices, by the continued distention of the exceeding thread loop 51*g* by the loop taker or by a combination thereof.

As the loop taker completes distention of the thread loop 51*g* and manipulates the loop completely about the support plate 20, tensile force in the thread loop will decrease so that forces urging the probe 38 and cam blade 39 toward the plate 26 will abate allowing spring 41 to return the lever 35 to a position away from the plate 26 so that the pin 28 by the action of spring 30 will rise to the position shown in FIGS. 4*a, b* and *c* in readiness to retain the loop 51*g*. In addition, the thread deflecting fin 43 serves to elevate the thread loop 51*g* as the loop taker beak distends the loop so that any tendency for the thread loop to be retained on the probe 38 will be obviated. Similarly, the thread deflecting fin 45 beneath the support plate 20 prevents the thread loop 51g from becoming caught on the cam blade 39.

Although the preferred embodiment described above involves a chain stitch conversion device for a conventional lock stitch sewing machine, it will be appreciated that the principles of this invention are applicable as well to a sewing machine constructed and intended only for the production of chain stitches. Moreover, when the principle of this invention is comprehended, numerous alternative arrangements will become apparent for harnessing the newly seized and manipulated thread so that it alone effects shedding of a previously retained thread loop.

The present invention not only provides the advantage of providing a chain stitch seam which will not ravel if stitches are inadvertently skipped, but it also makes possible a novel combination of chain stitch and intentional or predetermined skip stitch mechanisms for the production of utility chain stitches of abnormal length as for basting or the production of decorative chain stitches of this description.

I claim:

1. A chain stitch sewing machine comprising a work penetrating thread carrying needle, a circularly moving loop taker including a beak for seizing and manipulating loops of thread from said needle, a work feeding means for advancing work between needle penetrations, actuating mechanism for operating said needle, loop taker and work feeding means cooperatively, a thread loop retaining means for retaining loops of thread seized by said beak from said needle and supporting said loops of thread in a position for penetration by said thread carrying needle, thread loop shedding means operative to effect release of a thread loop from said thread loop retaining means, and means responsive solely to the action of a subsequently seized thread loop as it is being manipulated by said loop taker beak and before it is retained by said thread loop retaining means for operating said thread loop shedding means to release a previously retained thread loop.

2. A chain stitch sewing machine as set forth in claim 1 in combination with a skip stitch mechanism for rendering needle thread loop seizure by said loop taker beak selectively ineffective whereby patterns of uninterrupted chain stitches are attainable having stitch lengths which are multiples of that provided by operation of said work feeding means.

3. A chainstitch conversion device for a lock stitch sewing machine of the type having a work penetrating thread carrying needle, and a circularly moving loop taker including a beak for seizing and manipulating loops of thread from said needle, said chain stitch conversion device comprising a thread loop retaining means for retaining loops of thread seized by said beak from said needle and supporting said loops of thread in a position for penetration by said thread carrying needle, thread loop shedding means operative to effect release of a thread loop from said thread loop retaining means, and means responsive solely to the action of a subsequently seized thread loop as it is being manipulated by said loop taker beak and before it is retained by said thread loop retaining means for operating said thread loop shedding means to release a previously retained thread loop.

4. A chain stitch conversion device for a lock stitch sewing machine of the type having a work penetrating thread carrying needle, and a circularly moving loop taker including a beak for seizing and manipulating loops of thread from said needle, said chain stitch conversion device comprising a thread loop retaining means for retaining loops of thread seized by said beak from said needle and supporting said loops of thread in a position for penetration by said thread carrying needle, thread loop shedding means operative to effect release of a thread loop from said thread loop retaining means, a thread engaging probe supported in the path of and responsive to forces in a thread limb seized and being manipulated by said loop taker beak before it is retained by said thread retaining means, and means effected by said response of said thread engaging probe to forces in said thread limb for operating said thread loop shedding means to release a previously retained thread loop.

5. A chain stitch conversion device for a lock stitch sewing machine of the type having a work penetrating thread carrying needle, and a circularly moving loop taker including a beak for seizing and manipulating loops of thread from said needle, and means for accommodating a lock stitch bobbin case in said loop taker, said chain stitch conversion device comprising a thread loop retaining means associated with said bobbin case accommodating means in said loop taker for retaining loops of thread seized by said beak from said needle and supporting said loops of thread in a position for penetration by said thread carrying needle, means shiftably supporting said thread loop retaining means relatively to said loop taker for movement effective to shed a thread loop retained thereon, and means responsive solely to the action of a thread limb extending from said needle and seized and manipulated by said loop taker beak for effecting said shedding movement of said thread loop retaining means.

6. A chain stitch conversion device for a lock stitch sewing machine of the type having a work penetrating thread carrying needle, and a circularly moving loop taker including a beak for seizing and manipulating loops of thread from said needle, said chain stitch conversion device comprising a support sustained by said bobbin case accommodating means in said loop taker, a thread loop retaining means carried on said support for retaining loops of thread seized by said beak from said needle and supporting said loops of thread in a position for penetration by said thread carrying needle, thread loop shedding means operative to effect release of a thread loop from said thread loop retaining means, and means carried by said support and responsive solely to the action of a subsequently seized thread loop as it is being manipulated by said loop taker beak and before it is retained by said thread loop retaining means for operating said thread loop shedding means to release a previously retained thread loop.

7. A chain stitch conversion device for a lock stitch sewing machine of the type having a work penetrating thread carrying needle, and a circularly moving loop taker including a beak for seizing and manipulating loops of thread from said needle, said chain stitch conversion device comprising a support plate adapted to be substituted for a bobbin case in said bobbin case accommodating means in said loop taker, a thread loop retainer means in said loop taker, a thread loop retainer shiftably supported on said support plate and projectable through an aperture therein into a position effective to retain a thread loop for penetration by said thread carrying needle, means for retracting said thread loop retainer to effect shedding of a thread loop retained thereon, thread engaging means shiftably supported on said support plate in the path of thread seized and being manipulated by said loop taker beak, and operative connections between said thread engaging means and said thread loop retainer for effecting loop shedding retraction of said thread loop retainer solely in response to thread influenced shift of said thread engaging means.

* * * * *